US006520143B2

(12) United States Patent
Wengert

(10) Patent No.: US 6,520,143 B2
(45) Date of Patent: Feb. 18, 2003

(54) PREINJECTION VALVE FOR CONTROLLING THE FUEL INFLOW OF A FUEL INJECTION VALVE

(75) Inventor: Andreas Wengert, Oppenweiler-Reichenberg (DE)

(73) Assignee: Ronbert Bosch GmbH, Stuttgart (DE)

( * ) Notice: Subject to any disclaimer, the term of this patent is extended or adjusted under 35 U.S.C. 154(b) by 0 days.

(21) Appl. No.: 09/849,620

(22) Filed: May 7, 2001

(65) Prior Publication Data

US 2002/0108653 A1 Aug. 15, 2002

(30) Foreign Application Priority Data

May 9, 2000 (DE) ..... 100 22 421

(51) Int. Cl.[7] ..... F02M 45/04
(52) U.S. Cl. ..... 123/300; 123/299
(58) Field of Search ..... 123/299, 300

(56) References Cited

U.S. PATENT DOCUMENTS 3,392,715 A * 7/1968 Thoma ..... 123/299 X
3,394,891 A * 7/1968 Voit ..... 123/299 X
4,289,098 A * 9/1981 Norberg et al. ..... 123/299
4,389,987 A * 6/1983 Frankle et al. ..... 123/300
4,520,774 A * 6/1985 Sitter ..... 123/300
4,572,124 A * 2/1986 Nicol ..... 123/300
4,612,905 A * 9/1986 Dietrich et al. ..... 123/300 X
4,681,073 A * 7/1987 Poore ..... 123/300 X

* cited by examiner

*Primary Examiner*—John Rivell
(74) *Attorney, Agent, or Firm*—Ronald E. Greigg

(57) ABSTRACT

A preinjection valve with a valve body, in which an inlet conduit is embodied which can be filled with fuel at high pressure via a high-pressure pump. An outlet conduit is embodied in the valve body and discharges laterally into the inlet conduit and communicates with a fuel injection valve via a high-pressure line. A preinjection valve member is guided sealingly in the inlet conduit and is moved counter to a closing force by the fuel pressure in the inlet conduit and after executing a preinjection stroke ($h_v$) comes to rest on a deflection valve member guided, likewise sealingly, in the inlet conduit. By the motion of the preinjection valve member, a preinjection quantity is pumped into the outlet conduit and delivered to the fuel injection valve. When a main injection pressure in the inlet conduit is attained, the deflection valve member is moved by the fuel pressure until, on traversing an opening stroke ($h_0$), the communication from the inlet conduit into the outlet conduit is opened, and fuel can flow to the fuel injection valve.

10 Claims, 3 Drawing Sheets

PREINJECTION VALVE FOR CONTROLLING THE FUEL INFLOW OF A FUEL INJECTION VALVE

BACKGROUND OF THE INVENTION

1. Field of the Invention

The invention is based on a preinjection valve for controlling the fuel inflow of a fuel injection valve.

2. Description of the Prior Art

A preinjection valve of the type with which this invention is concerned is described in German Published, Nonexamined Patent Application DE 40 21 453 A1. In such a preinjection valve, an inlet conduit communicates with a high-pressure fuel pump, which pumps fuel at high pressure into the inlet conduit. A preinjection valve member is disposed sealingly in a bore that communicates with the inlet conduit, so that one side is acted upon by the fuel pressure of the inlet conduit. When the pressure in the inlet conduit reaches a certain level, the preinjection valve member moves counter to a closing force as far as a stop and thereby pumps a fixedly predetermined preinjection quantity into an outlet conduit that communicates with the fuel injection valve. The preinjection valve furthermore has a deflection valve member, which is sealingly guided in a second bore and one face end of which also communicates with the inlet conduit. After the preinjection quantity has been pumped by the preinjection valve member, the fuel pressure in the inlet conduit rises still more. When a threshold pressure for the main injection is reached, the deflection valve member moves counter to a closing force and thereby enables the communication from the inlet conduit to the outlet conduit, which communicates with the injection valve. The fuel flows to the fuel injection valve via the outlet conduit until such time as the deflection valve member closes again as a result of a drop in the fuel pressure in the inlet conduit, and the injection is terminated.

The known preinjection valve has the disadvantage that two guide bores must be made, one each for the preinjection valve member and the deflection valve member. This makes a compact design of the preinjection valve more difficult and necessitates at least one branch of the inlet conduit coming from the high-pressure pump, and this branch has to be rounded, which is complicated.

SUMMARY OF THE INVENTION

The preinjection valve of the invention for controlling the fuel inflow of a fuel injection valve has the advantage over the prior art that a compact design of the preinjection valve is possible, thus enabling the preinjection valve to be built into either the inlet conduit of the fuel injection valve or inside the fuel injection valve. Because of the disposition of the preinjection valve member in the same inlet conduit as the deflection valve member, there is no need to form a complicated branch in the inlet conduit.

In an advantageous feature of the subject of the invention, the preinjection valve member is embodied as a ball, which is guided sealingly in the inlet conduit and is braced, via a closing spring, on the pistonlike deflection valve member. The deflection valve member extends as far as the inside of a spring chamber, where it merges with a spring plate. Between the spring plate and the opposed wall of the spring chamber, a closing spring is disposed with prestressing. A compensation disk is disposed between the face end of the spring chamber, toward the preinjection valve member, and the spring plate. By varying the thickness of this compensation disk, the preinjection quantity of the preinjection valve member can advantageously be changed easily. By means of a suitable design of the closing springs, the opening pressure of the preinjection and main injection can be set, and thus for a given course over time of the pressure rise in the inlet conduit in the injection, the time interval between the preinjection and the main injection can also be set.

BRIEF DESCRIPTION OF THE DRAWINGS

Further advantages and advantageous features of the subject of the invention can be learned from the detailed description contain below, taken with the drawings, in which.

DESCRIPTION OF THE PREFERRED EMBODIMENTS

Figure 1:
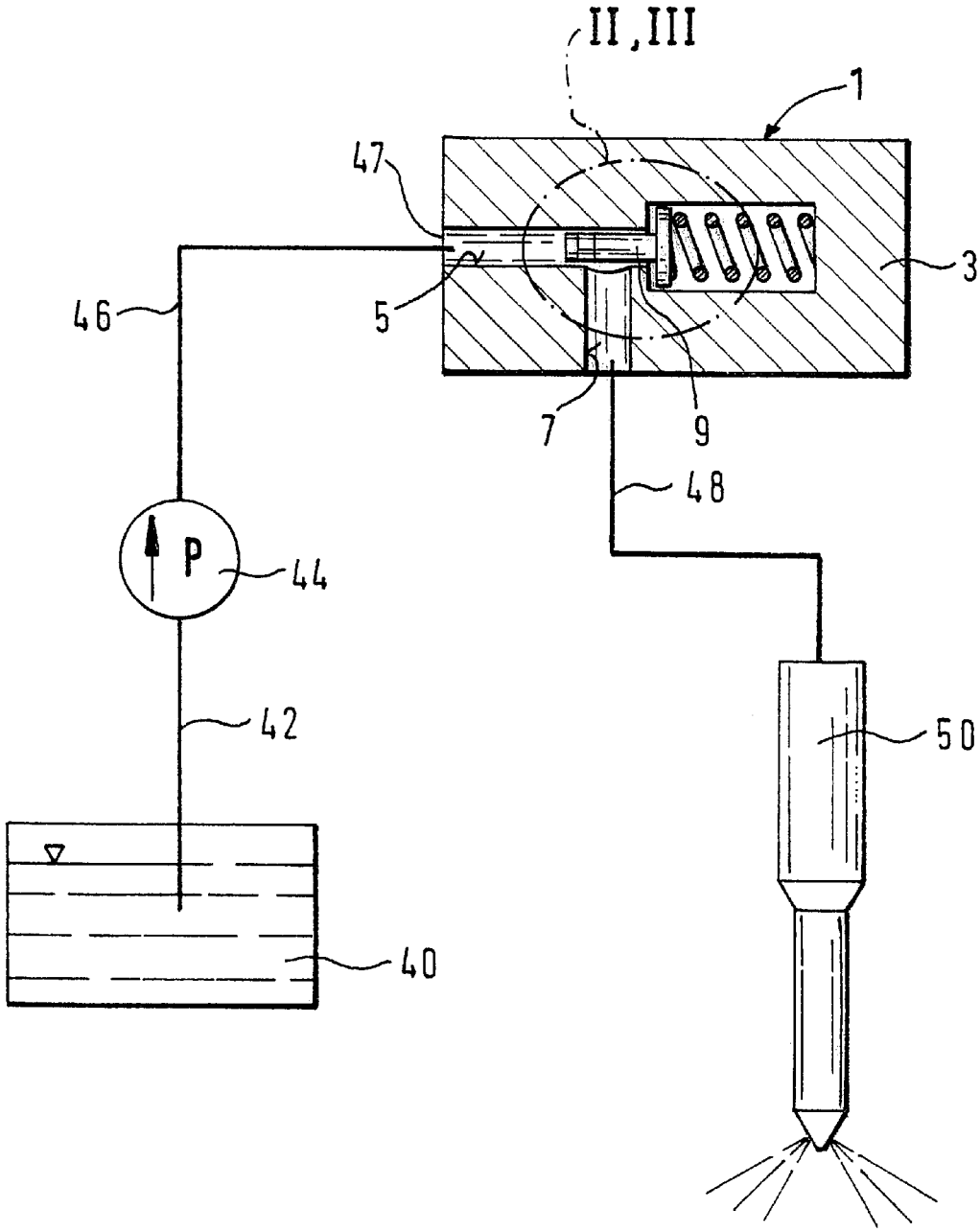
FIG. 1 shows the installed position of the fuel injection valves schematically.

FIG. 1 schematically shows the installed position of a preinjection valve 1 for supplying a fuel injection valve with fuel. Via an inlet conduit 42, a high-pressure pump 44 pumps fuel from a fuel tank 40. The fuel is forced at high pressure into a high-pressure line 46, which connects the high-pressure pump 44 with a high-pressure connection 47 of an inlet conduit 5, the inlet conduit 5 being embodied in a valve body 3 of the preinjection valve 1. Via an outlet conduit 7 embodied in the valve body 3, the fuel is introduced, controlled by a deflection valve member 9, out of the inlet conduit 5 into a high-pressure line 48 and thus delivered to a fuel injection valve 50. The fuel injection valve 50 is disposed in an internal combustion engine, not shown in the drawing, and injects the fuel directly into the engine combustion chamber.

Figure 2:
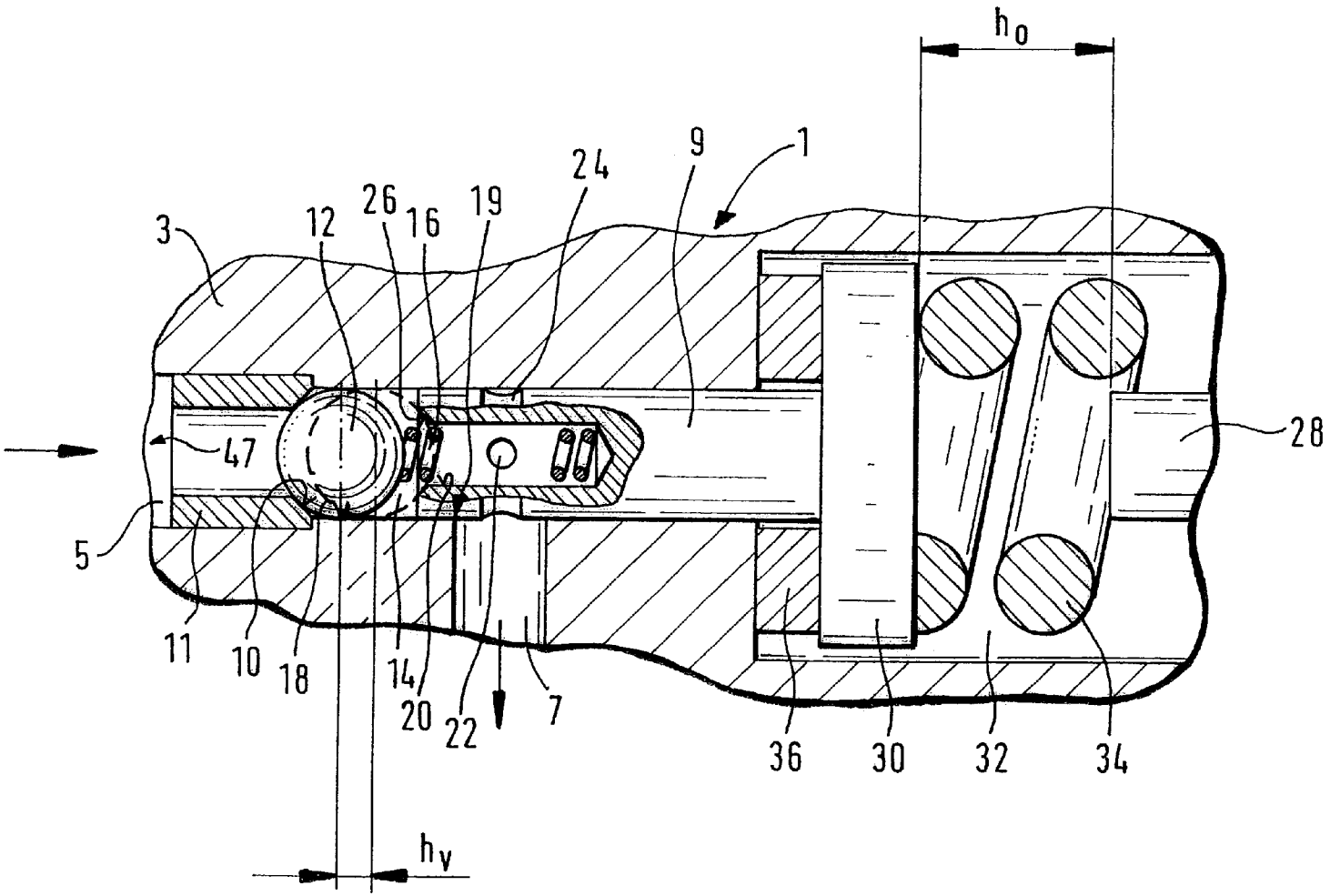
FIG. 2 shows a longitudinal section through a fuel injection valve of the invention in a first exemplary embodiment.

In FIG. 2, a first exemplary embodiment of a fuel injection valve of the invention is shown, enlarged, in longitudinal section. Via the high-pressure connection 47, not shown in FIG. 2, the inlet conduit 5 communicates with the high-pressure line 46 and is filled by way of it with fuel at high pressure. The outlet conduit 7 is embodied in the valve body 3; it discharges laterally from the inlet conduit 5 and communicates with the high-pressure line 48. The edge formed by the orifice of the outlet conduit 7 and the inlet conduit 5 defines an opening edge 19.

The pistonlike deflection valve member 9 is disposed longitudinally displaceably in the inlet conduit 5 and on its side remote from the high-pressure connection 47, it changes into a spring plate 30, which is disposed in a spring chamber 32 embodied in the valve body 3. Between the spring plate 30 and the face end, remote from the deflection valve member 9, of the spring chamber 32, there is a closing spring 34, by which a closing force is exerted on the deflection valve member 9, so that the deflection valve member 9 is movable in the inlet conduit 5 only counter to the force of the closing spring 34. The axial motion is limited by a stop 28, disposed in the spring chamber 32, to the opening stroke $h_0$. The spring plate 30 is braced via a compensation disk 36 on the face end, toward the high-pressure connection 47, of the spring chamber 32, so that the force of the closing spring 34 can be varied by way of the thickness of the compensation disk 36.

Between the high-pressure connection 47 and the deflection valve member 9, there is a ball-shaped preinjection valve member 12, which is guided sealingly in the inlet conduit 5; a control edge 18 is formed by the contacting edge of the preinjection valve member 12 in the inlet conduit 5. The preinjection valve member 12 is acted upon, on its side toward the high-pressure connection 47, by the high fuel pressure of the inlet conduit 5 and is braced, remote from the high-pressure connection 47, on the deflection valve member 9 via a closing spring 16 that generates a closing force.

The closing spring 16 that acts on the preinjection valve member 12 will be referred to hereinafter as the first closing spring 16, and its force will be called the first closing force, while the closing spring 34 acting on the deflection valve member 9 will be referred to as the second closing spring 34, with an associated second closing force.

The first closing spring 16 is disposed in a longitudinal bore 20 of the deflection valve member 9. An annular groove 24 is embodied on the deflection valve member 9; it communicates with the longitudinal bore 20 via at least one transverse bore 22 and in the closed state of the fuel injection valve, that is, when the spring plate 30 is in contact with the compensation disk 36, it is disposed at the level of the orifice of the outlet conduit 7 from the inlet conduit 5. If there is no fuel pressure or only slight fuel pressure in the inlet conduit 5, then the preinjection valve member 12 is pressed by the first closing spring 16 against a stop face 10, which is embodied on the face end of a stop sleeve 11 disposed in the inlet conduit 5. By a motion counter to the closing force of the first closing spring 16, the preinjection valve member 12 can move axially in the inlet conduit 5, and after traversing a preinjection stroke $h_v$, it comes to rest on a stop face 26 which is formed on the face end, toward the preinjection valve member 12, of the deflection valve member 9. In this motion, the preinjection valve member 12 displaces a preinjection volume 14, which is defined by the product of the cross-sectional area of the inlet conduit 5 and the preinjection stroke $h_v$. The corresponding quantity of fuel is forced through the longitudinal bore 20 and the transverse 22 into the annular groove 24, and from there reaches the outlet conduit 7.

The mode of operation of the preinjection valve is as follows: At the onset of the injection event, the high-pressure pump 44 pumps fuel via the high-pressure line 46 into the inlet conduit 5. There the fuel pressure rises, until the hydraulic force on the preinjection valve member 12 is greater than the force of the first closing spring 16. The preinjection valve member 12 moves from the stop face 10, embodied on the stop sleeve 11, along the inlet conduit 5 until it comes to rest on the stop face 26 embodied on the deflection valve member 9. By the motion of the preinjection valve member 12, the fuel is displaced in the preinjection volume 14 and is forced through the longitudinal bore 20 and the transverse bore 22 into the outlet conduit 7 via the annular groove 24. The preinjection quantity thus pumped is injected by the fuel injection valve 50 into the combustion chamber of the engine. Once the preinjection valve member 12 has traversed the preinjection stroke $h_v$, the fuel pressure in the inlet conduit 5 rises still further. When the hydraulic force on the preinjection valve member 12 reaches the force of the second closing spring 34, the preinjection valve member 12 and thus also the deflection valve member 9 are moved toward the spring chamber 32, counter to the force of the second closing spring 34. When the control edge 18 embodied on the preinjection valve member 12 reaches the opening edge 19, then the inlet conduit 5 communicates with the outlet conduit 7, and fuel is delivered to the fuel injection valve 50 via the high-pressure line 48. The motion of the deflection valve member 9 is limited by the stop 28 embodied in the spring chamber 32. The end of the injection event is initiated by the fact that the fuel pressure in the inlet conduit 5 drops. If the hydraulic force on the preinjection valve member 12 drops far enough that it is less than the force of the second closing spring 34, then the deflection valve member 9 and thus also the preinjection valve member 12 move until the spring plate 30, connected to the deflection valve member 9, comes to rest on the compensation disk 36. The preinjection valve member 12 continues its motion in response to the force of the first closing spring 16 until the preinjection valve member 12 comes to rest on the stop face 10 of the stop sleeve 11.

Figure 3:
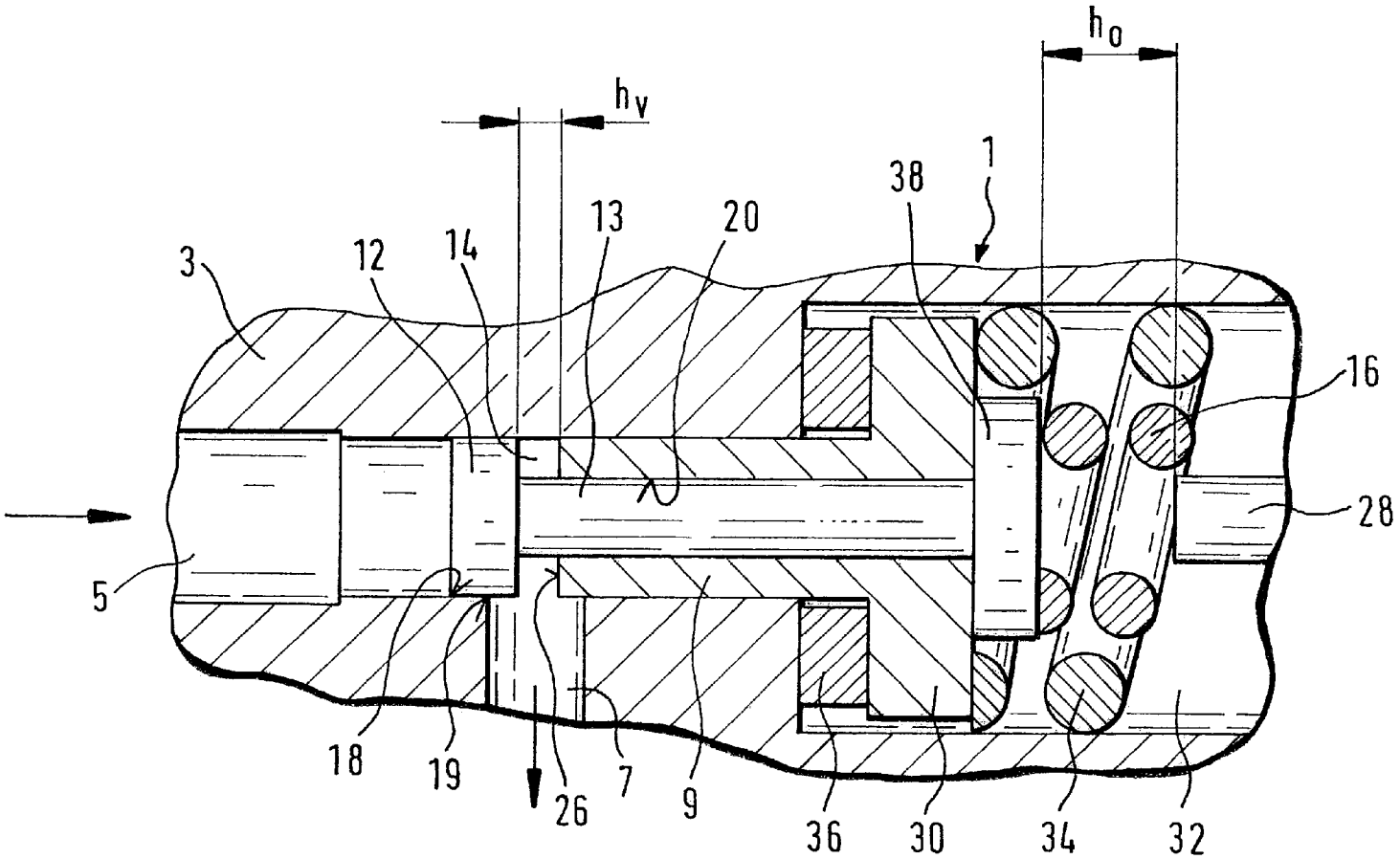
FIG. 3 shows a longitudinal section through a second exemplary embodiment of a preinjection valve of the invention.

In FIG. 3, a longitudinal section is shown through a second exemplary embodiment of the preinjection valve of the invention. Here the inlet conduit 5 is closed by a pistonlike preinjection valve member 12, which is disposed between the high-pressure connection 47 and the likewise pistonlike deflection valve member 9. Between the preinjection valve member 12 and the face end 26, toward the preinjection valve member 12, of the deflection valve member 9, the preinjection volume 14 is formed, which defines the preinjection quantity of the preinjection valve 1.

The deflection valve member 9 is guided sealingly in the inlet conduit 5 and protrudes as far as the inside of a spring chamber 32 embodied in the valve body, and from there the deflection valve member merges with a spring plate 30. The deflection valve member 9 has a longitudinal bore 20, which is embodied coaxially with the longitudinal axis of the deflection valve member 9. A piston rod 13 is guided sealingly in this longitudinal bore 20; with its face end remote from the spring chamber 32, it is connected to the preinjection valve member 12, and which piston rod 13 protrudes as far as the inside of the spring chamber 32, where it is connected to a spring disk 38. There are two closing springs in the spring chamber 32. The first closing spring 16 is disposed between the spring disk 38 of the preinjection valve member 12 and the end, remote from the deflection valve member 9, of the spring chamber 32, and the second closing spring 34 of the deflection valve member 9 is disposed between the spring plate 30 and the end, remote from the preinjection valve member 12, of the spring chamber 32. By the force of the first closing spring 16, the spring disk 38 is pressed against the spring plate 30, and the spring plate 30 is additionally pressed by the force of the second closing spring 34, with the interposition of a compensation disk 36, toward the end of the spring chamber 32 oriented toward the preinjection valve member 12. A stop 28 which defines the maximum opening stroke ho of the deflection valve member 9 is disposed in the spring chamber 32.

The mode of operation of the preinjection valve is as follows: Fuel is introduced into the inlet conduit 5 via the high-pressure line 46 by the high-pressure pump 44. As a result, the fuel pressure in the inlet conduit 5 rises, and thus the hydraulic force on the face end of the preinjection valve member 12 rises as well. If the hydraulic force on the preinjection valve member 12 exceeds the force of the first closing spring 16, then the preinjection valve member 12 moves axially toward the spring chamber 32, until it comes to rest on the stop face 26 of the deflection valve member 9. By this motion of the preinjection valve member 12, the fuel in the preinjection volume 14 is positively displaced and forced into the outlet conduit 7. From there, the fuel flows via the high-pressure line 48 to reach the fuel injection valve 50, and it is injected by this valve into the combustion chamber of the engine.

After the termination of the preinjection stroke $h_v$ of the preinjection valve member 12, the fuel pressure in the inlet conduit 5 rises still more, until the hydraulic force on the preinjection valve member 12 becomes greater than the closing force of the first closing spring 16 and the second closing spring 34 taken together. The preinjection valve member 12 is moved together with the deflection valve member 9 toward the spring chamber 32, until the spring plate 30, after the traversal of the opening stroke $h_0$, comes to rest on the stop 28 and limits the opening motion of the deflection valve member 9 and the preinjection valve member 12. As soon as the control edge 18 embodied on the preinjection valve member 12 has reached the opening edge 19 of the outlet conduit 7, the inlet conduit 5 communicates with the outlet conduit 7, and fuel is delivered through the outlet conduit 7 via the high-pressure line 48 to the fuel injection valve 50.

The end of the injection is initiated by the fact that the fuel pressure in the inlet conduit 5 drops. If the hydraulic force on the end face of the preinjection valve member 12 drops below the force of the second closing spring 34 and the first closing spring 16, then the deflection valve member 9 and thus also the preinjection valve member 12 move away from the spring chamber 32, until the spring plate 30 comes to rest on the compensation disk 36 and the spring disk 38 comes to rest on the spring plate 30. As soon as the control edge 18 has reached the opening edge 19, the communication of the inlet conduit 5 with the outlet conduit 7 is broken, and the injection is terminated.

As an alternate to the disposition of the preinjection valve 1 as shown in FIG. 1, it can also be provided that the preinjection valve is not built directly into the high-pressure line 46, 48 but instead is integrated directly with the fuel injection valve 50. This makes a compact and hence space-saving design possible, and it is less complicated to install the fuel injection system in the engine.

It can also be provided that the valve body 3 of the preinjection valve 1 is constructed in multiple parts. This makes it easily possible to replace the closing springs 16, 34 or the valve members 9, 12. In the exemplary embodiment shown in FIG. 2, for instance, the preinjection volume 14 can easily be changed by replacing the compensation disk 36.

Via the ratio between the force of the first closing spring 16 and the force of the second closing spring 34, for a given chronological course of the pressure rise by means of the high-pressure pump 44 in the inlet conduit 5 at the onset of injection, the time interval between the preinjection and the main injection can be set. This makes it possible to adapt the preinjection valve 1 to various demands made of the engine and the fuel injection valves, without having to change the construction of the preinjection valve.

The foregoing relates to preferred exemplary of embodiments of the invention, it being understood that other variants and embodiments thereof are possible within the spirit and scope of the invention, the latter being defined by the appended claims.

I claim:

1. A preinjection valve (1) for controlling the fuel inflow of a fuel injection valve (50), the preinjection valve comprising a valve body (3) in which an inlet conduit (5) and an outlet conduit (7) communicating with the inlet are embodied, the communication between the outlet conduit (7) and the inlet conduit (5) being controlled by a valve assembly having a preinjection valve member (12) which is guided in sealing fashion in the inlet conduit (5) and is acted upon on one side by the fuel pressure of the inlet conduit (5) and is movable counter to a first closing force, wherein, when fuel in the inlet conduit (5) reaches a certain pressure, the preinjection valve member (12) is moved counter to the first closing force through a preinjection stroke ($h_v$) and in the process pumps the fuel, located in a preinjection volume (14) into the outlet conduit (7), and having a deflection valve member (9), which can be acted upon at least indirectly by the fuel pressure in the inlet conduit (5), and which, after the motion of the preinjection valve member (12) through the preinjection stroke ($h_v$), is movable counter to a second closing force in such a way that the communication between the outlet conduit (7) and the inlet conduit (5) is opened, said preinjection valve member (12), after said motion through the preinjection stroke ($h_v$), coming to rest against said deflection valve member (9), and as the fuel pressure increases further in the inlet conduit (5), together with the deflection valve member (9), executes an opening stroke motion counter to the second closing force, or counter to the first and second closing forces, by which opening stroke motion the communication between the outlet conduit (7) and the inlet conduit (5) is opened.

2. The preinjection valve of claim 1, wherein said preinjection valve member (12) and said deflection valve member (9) are disposed at least approximately coaxially to one another.

3. The preinjection valve of claim 1, wherein said preinjection valve member (12) has a control edge (18) which cooperates with an opening edge (19) of the outlet conduit (7) embodied in the valve body (3).

4. The preinjection valve of claim 1, wherein said preinjection valve member (12) is embodied as a ball.

5. The preinjection valve of claim 1, wherein said preinjection valve member (12) is embodied in the shape of a piston.

6. The preinjection valve of claim 1, wherein said preinjection valve member (12) is braced at least indirectly on the valve body (3) counter to the fuel pressure in the inlet conduit (5) via a first closing spring (16) that generates the first closing force.

7. The preinjection valve of claim 1, wherein said preinjection valve member (12) is braced at least indirectly on the deflection valve member (9) counter to the fuel pressure in the inlet conduit (5) via a first closing spring (16) that generates the first closing force.

8. The preinjection valve of claim 1, wherein said second closing force on the deflection valve member (9) is generated by a second closing spring (34).

9. The preinjection valve of claim 2, wherein said preinjection valve member (12) has a control edge (18) which cooperates with an opening edge (19) of the outlet conduit (7) embodied in the valve body (3).

10. The preinjection valve of claim 2, wherein said preinjection valve member (12) is embodied as a ball.

* * * * *

UNITED STATES PATENT AND TRADEMARK OFFICE

CERTIFICATE OF CORRECTION

PATENT NO. : 6,520,143 B2
DATED : February 18, 2003
INVENTOR(S) : Andreas Wengert It is certified that error appears in the above-identified patent and that said Letters Patent is hereby corrected as shown below:

Title page,
Item [73], to read as follows:
-- [73] Assignee: Robert Bosch GmbH, Stuttgart (DE) --

Signed and Sealed this

Seventeenth Day of June, 2003

JAMES E. ROGAN
*Director of the United States Patent and Trademark Office*